US007036196B2

(12) United States Patent
Salatin et al.

(10) Patent No.: US 7,036,196 B2
(45) Date of Patent: May 2, 2006

(54) DISPLAY FOR A CASKET SELECTION AND/OR VIEWING ROOM

(75) Inventors: Randall S. Salatin, Greensburg, IN (US); Laios L. Szabo, Jr., Columbus, OH (US); Marcus R. Szabo, Columbus, OH (US); Terry L. Carpenter, Edwards, CO (US); Judith C. Steele, Columbus, OH (US)

(73) Assignee: Batesville Services, Inc., Batesville, IN (US)

( * ) Notice: Subject to any disclaimer, the term of this patent is extended or adjusted under 35 U.S.C. 154(b) by 223 days.

(21) Appl. No.: 10/233,861

(22) Filed: Sep. 3, 2002

(65) Prior Publication Data

US 2003/0000901 A1 Jan. 2, 2003

Related U.S. Application Data

(60) Division of application No. 09/638,576, filed on Aug. 15, 2000, now Pat. No. 6,681,510, which is a continuation of application No. 08/911,823, filed on Aug. 15, 1997, now abandoned.

(51) Int. Cl.
*A61G 17/00* (2006.01)

(52) U.S. Cl. ..... 27/27; 27/1; 52/128; 211/85.16

(58) Field of Classification Search ..... 27/27, 27/1; 40/313, 618, 661, 654.01, 775, 776, 40/642.01, 651; 52/128, 134, 129; 211/85.16, 211/162

See application file for complete search history.

(56) References Cited

U.S. PATENT DOCUMENTS 518,335 A 4/1894 Sherman
1,842,286 A 1/1932 Potter
2,665,184 A 1/1954 Hord
3,190,243 A 6/1965 Pira
3,191,320 A 6/1965 Copeland et al.
4,082,384 A 4/1978 Dold
4,140,224 A 2/1979 Celeste
4,160,570 A 7/1979 Bridges (Continued)

FOREIGN PATENT DOCUMENTS

FR 2 542 492 9/1984

(Continued)

OTHER PUBLICATIONS

Batesville Casket Company, Inc./Applied Retail Systems, *Partnership Marketing Program*, Brochure, 38 pages, undated.

(Continued)

*Primary Examiner*—Carl D. Friedman
*Assistant Examiner*—Yvonne M. Horton
(74) *Attorney, Agent, or Firm*—Wood, Herron & Evans, LLP

(57) ABSTRACT

A selection room display facilitates a casket selection by a customer of a funeral home. The display includes a vertical back wall and a pair of vertical, spaced apart wing walls cooperating with the back wall to form an alcove. A plurality of casket portions are displayed in the alcove. A vertical signage column may be positioned in the alcove. Information modules are also displayed in the alcove. The modules correspond to the casket portions. The casket portions are supported on shelves which are removably secured to the back wall. The information modules are similarly removably secured to the back wall. The display may incorporate "themes" to feature the various casket choices. The theme technique may also be utilized in the funeral home viewing room.

40 Claims, 6 Drawing Sheets

U.S. PATENT DOCUMENTS

| | | | |
|---|---|---|---|
| 4,304,076 | A | 12/1981 | Splendora |
| 4,403,700 | A | 9/1983 | Manklove |
| 4,508,231 | A | 4/1985 | Honickman |
| 4,615,448 | A | 10/1986 | Johnstonbaugh |
| 4,688,359 | A | 8/1987 | See |
| 4,825,601 | A | 5/1989 | Halverson |
| 4,930,628 | A | 6/1990 | Bridges |
| 5,333,744 | A | 8/1994 | LoCicero et al. |
| 5,405,017 | A | 4/1995 | Szabo, Sr. et al. |
| 5,495,954 | A | 3/1996 | Schmidt |
| 5,524,394 | A | 6/1996 | Szabo, Sr. et al. |
| 5,526,943 | A | 6/1996 | Thompson |
| 5,622,010 | A | 4/1997 | Weber |
| 5,707,126 | A | 1/1998 | Neufeld et al. |
| 5,709,052 | A | 1/1998 | Szabo, Sr. et al. |
| 5,755,499 | A | 5/1998 | Hillesland |
| 5,759,045 | A | 6/1998 | Gabig et al. |
| 5,787,626 | A | 8/1998 | Bingham et al. |
| D398,026 | S | 9/1998 | Riga |
| D398,027 | S | 9/1998 | Riga |
| D398,654 | S | 9/1998 | Riga |
| 5,800,027 | A | 9/1998 | Dunn |
| D399,880 | S | 10/1998 | Riga |
| 5,848,498 | A | 12/1998 | Szabo, Sr. et al. |
| 5,848,698 | A | 12/1998 | Stompe |
| D405,583 | S | 2/1999 | Zimmerman |
| 5,901,862 | A | 5/1999 | Riga et al. |
| 6,073,320 | A | 6/2000 | Salatin et al. |
| 6,145,671 | A * | 11/2000 | Riga et al. ..... 211/13.1 |
| 6,145,672 | A | 11/2000 | Bachman et al. |
| D440,796 | S | 4/2001 | Riga |
| 6,276,034 | B1 | 9/2001 | Bachman et al. |
| 6,343,701 | B1 * | 2/2002 | Riga et al. ..... 211/85.16 |
| 6,681,510 | B1 * | 1/2004 | Salatin et al. ..... 40/661 |

FOREIGN PATENT DOCUMENTS

| | | |
|---|---|---|
| FR | 2674735 | 10/1992 |
| GB | 2224923 | 5/1990 |
| JP | 08 150183 | 6/1996 |
| WO | WO84/02261 | 6/1984 |
| WO | WO89/04129 | 5/1989 |
| WO | WO 96 35404 | 11/1996 |

OTHER PUBLICATIONS

Lajos Szabo, *American Funeral Director*, Feb. 1997, "The Three C's of Selection Rooms", 3 pages.

*Selection Room Display In Public Use Prior To Aug. 15, 1997* , 3 Color Photographs.

* cited by examiner

DISPLAY FOR A CASKET SELECTION AND/OR VIEWING ROOM

This application is a division of Ser. No. 09/638,576, filed Aug. 15, 2000, now U.S. Pat. No. 6,681,510, which is a continuation of Ser. No. 08/911,823, filed Aug. 15, 1997, now abandoned.

FIELD OF THE INVENTION

This invention relates generally to the funeral service industry, and more particularly to a display system facilitating the selection by a customer of a casket in a funeral home selection room.

BACKGROUND OF THE INVENTION

Funeral home casket selection rooms have evolved as those in the industry have attempted to better meet the funeral customers' needs. The "traditional" presentation of product in a funeral home selection room was to simply place each casket on a bier and open the head end cap or lid of the casket to permit viewing inside the casket. As many caskets as possible were displayed in a selection room in order to maximize the number of product choices for the customer. Unfortunately, such a "traditional" presentation results in what has been referred to as a "sea of caskets" effect, which can be both distressing or alarming and confusing to the customer.

Advances in the design of funeral home selection rooms have taken the form of providing a plurality of alcove structures, either of a "modular" construction or of a "stick built" construction, in the funeral home selection room. Each alcove structure includes a vertical back wall and a pair of vertical, spaced apart wing walls cooperating with the back wall to form an alcove. A soffit may span the upper front edges of the wing walls, and lighting, for example track lighting, may be incorporated into the soffit. A two-tier casket rack is located within the alcove, the lower tier of the casket rack being a roll out rack permitting the lower casket to be rolled out from under the upper casket and the casket lid opened for display of the lower casket. Tasteful signage and the like is mounted on the back wall above the caskets. Such a construction, which is the subject of the assignee's prior U.S. Pat. Nos. 5,405,017 and 5,524,394, both increases the number of caskets which can be displayed in a funeral home selection room, as well as greatly improves the "look and feel" of the casket presentations, reducing the clutter and confusion of the so-called "sea of caskets" effect and providing a feeling of comfort to the families. U.S. Pat. Nos. 5,405,017 and 5,524,394 are hereby incorporated by reference herein at this point as if fully set forth in their entirety.

New construction and renovation costs being what they are, there is an ever-increasing need to increase the product density displayable in the funeral home selection room, without sacrificing comfort, convenience and look and feel of the casket display systems of U.S. Pat. Nos. 5,405,017 and 5,524,394.

SUMMARY OF THE INVENTION

Accordingly, the present invention provides a number of selection room displays for facilitating the selection of a casket by a customer of the funeral home, which displays increase the density of product displayable in the selection room yet without compromising the pleasing look and feel of prior displays. One such selection room display comprises a vertical back wall and a pair of vertical, spaced apart wing walls cooperating with the back wall to form an alcove. A plurality of casket portions are displayed in the alcove. The plurality of casket portions represent a plurality of casket choices from which the customer may select. A vertical signage column or graphics tower is positioned in the alcove and displays information. The column would display information to create a "theme" for the alcove, such as informational and inspirational graphics; text and copy and lifestyle imagery.

In another aspect, a selection room display is provided which comprises as before, a vertical back wall and a pair of vertical, spaced apart wing walls cooperating with the back wall to form an alcove. A plurality of casket portions are displayed in the alcove, with each of the plurality of casket portions being removably positioned atop a shelf which itself is removably secured to the back wall. A plurality of casket information modules are displayed in the alcove, with each information module being removably secured to the back wall and corresponding to one of a plurality of casket portions.

In yet another aspect, an information insert for use in a selection room display is provided. The information insert is fabricated of a transparent material and comprises a first pocket having upper and lower edges and having a generally C-shaped cross section, a second pocket attached to the upper edge of the first pocket, the second pocket having a generally U-shaped cross section, and a third pocket attached to the lower edge of the first pocket, the third pocket having a generally U-shaped cross section. The second and third pockets have lower and upper edges, respectively; the lower edge of the second pocket is spaced above the upper edge of the third pocket. In an alternative embodiment, the third or lower pocket is eliminated.

In still another aspect, an information module for use in a selection room display is provided. The information module comprises an enclosure including a door pivotable to and between a closed position and an open position, and the above-mentioned information insert, which is movable into and out of the enclosure.

In a further aspect of the present invention, a selection room display is provided which comprises a vertical back wall including-at least one horizontal groove therein. A plurality of shelves are removably secured to the back wall. Each shelf of the plurality includes an upstanding lip on a back edge thereof. The lip is received in the horizontal groove thereby cantilevering the shelf from the back wall. Each of a plurality of casket portions is displayed on one of the shelves. A plurality of casket information modules are displayed on the back wall. Each of the information modules includes an upstanding lip on a back edge thereof. The lip is received in the horizontal groove thereby cantilevering the information module from the back wall as well.

In a further aspect of the present invention, a selection room display is provided which comprises a vertical back wall and two pairs of vertical, spaced apart wing walls cooperating with the back wall to form a centrally positioned center alcove and two laterally positioned side alcoves. An entire casket is displayed in the center alcove, and a plurality of casket portions are displayed in each of the side alcoves. In an alternative embodiment, one of the side alcoves is eliminated.

The display system of the present invention includes a number of additional features. For example, the vertical signage column has a square cross section. The signage column extends from the floor substantially to an upper edge of the back wall of the alcove. The signage column is positioned in the alcove such that one wall of the column abuts the back wall and another adjacent wall of the column abuts one of the wing walls.

The first pocket of the information insert includes therein a portion of the cap panel of the casket. The second pocket includes therein a photo of the casket and the third pocket includes therein a fabric swatch of the casket. The information insert further includes a hook on an upper back side thereof. The hook is positionable over an upper edge of the door of the enclosure of the information module when the door is in the open position and the information insert is removed from the enclosure to thereby display the information insert.

In the three alcove selection room display, the full size casket is supported atop a floor engaging support. Each of the plurality of casket portions is removably positioned atop a shelf which is removably secured to the back wall, as described above. Either or both of the side alcoves may include a vertical signage column therein. The side alcoves further include a plurality of the above-described casket information modules displayed therein and removably secured to the back wall thereof. This three alcove display may further include cremation urns, vaults, head stones and sympathy cards displayed in the side alcoves. Graphics may be displayed on a central portion of the back wall forming the center alcove to create a "theme". Similarly, graphics may be displayed on the signage columns to likewise create a "theme."

The present invention may also be utilized in a funeral home viewing room for displaying a body of a deceased. The viewing room comprises a vertical back room wall and a pair of vertical side room walls. A pair of vertical, horizontally spaced apart wing walls cooperate with the back room wall to form an alcove. A casket containing the body is positioned within the alcove. Signage forms the background for the casket. The signage includes text and/or graphics to create a theme. The theme is preferably patterned along the lifestyle of the deceased, for example, gender, religion, sports, politics, patriotism, outdoors and/or athletics.

The present invention therefore provides a number of display systems for use in a funeral home selection room which not only increase the number of product choices displayable in the selection room and therefore available to be chosen by the customer, but do so in a way which is tasteful and visually appealing. The invention also provides a funeral home viewing room.

These and other advantages of the present invention will become more readily apparent during the following detailed description taken in conjunction with the drawings herein, in which:

DETAILED DESCRIPTION OF THE INVENTION

Figure 1:
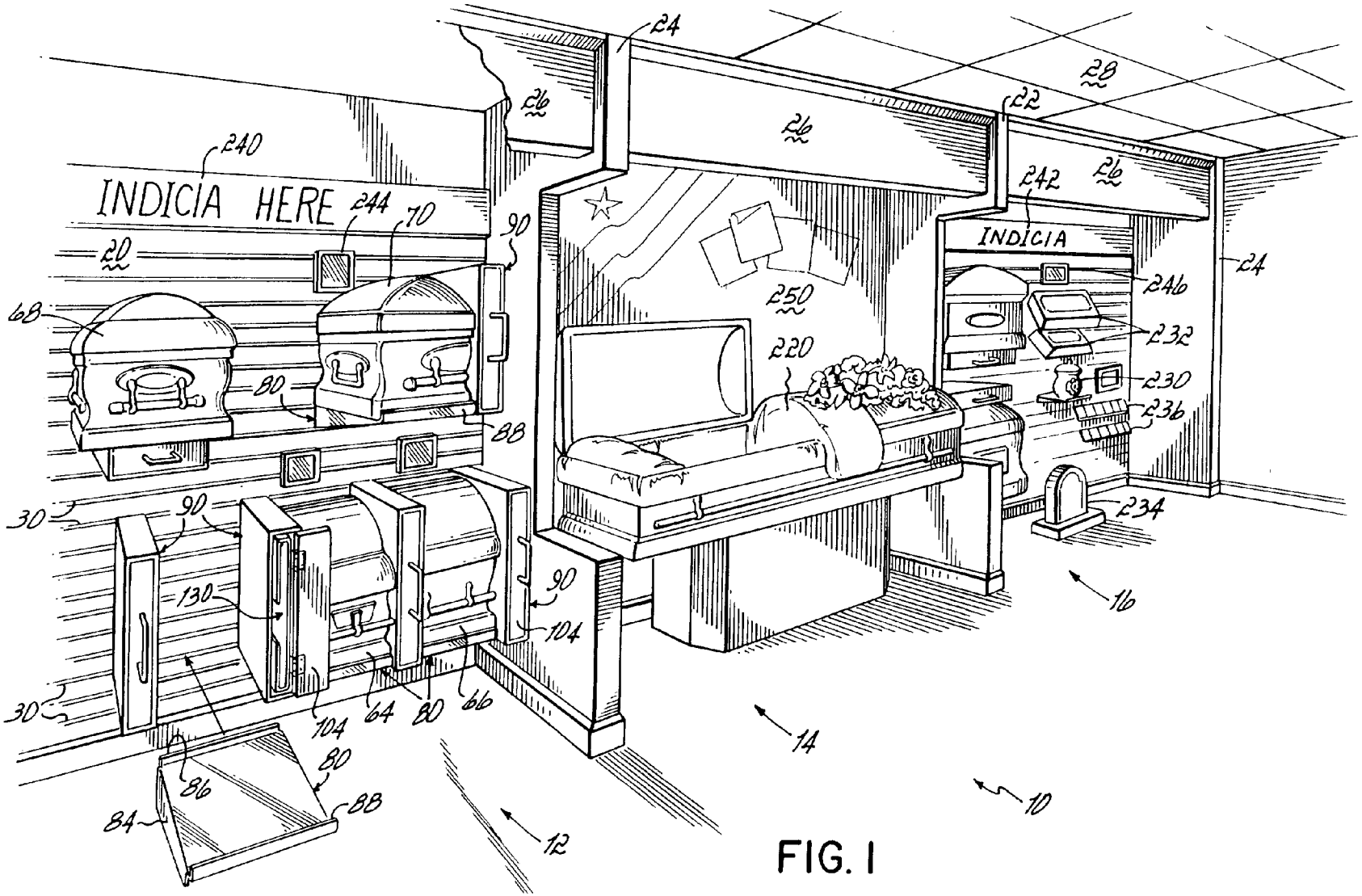
FIG. 1 is a perspective view of a wall of a funeral home selection room including three alcoves, the center alcove including an entire casket, and the two side alcoves including a plurality of casket portions displayed therein and information modules associated with the casket portions displayed therein.
Figure 2:
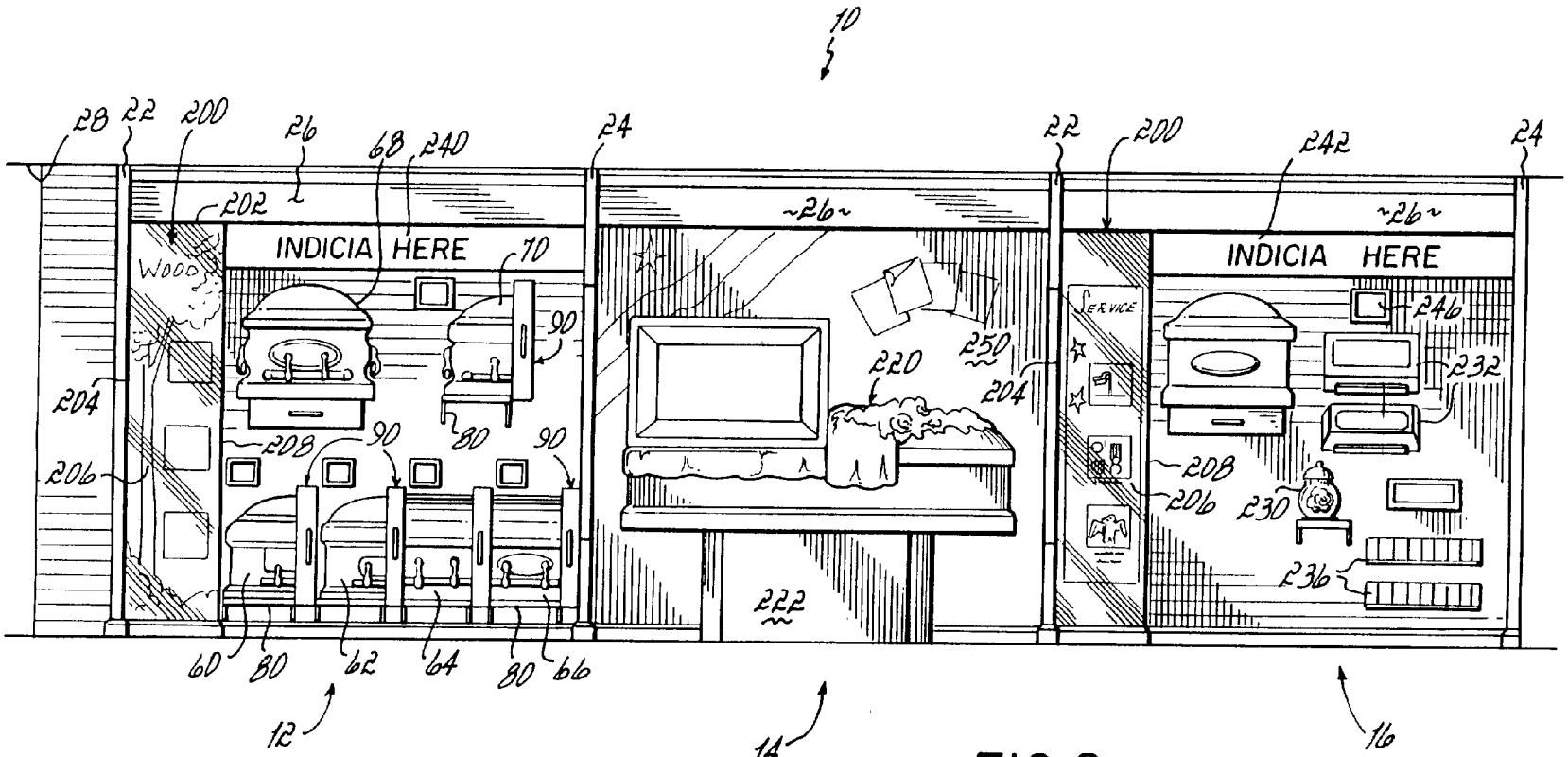
FIG. 2 is a front elevational view of the display of FIG. 1.

Referring first to FIGS. 1 and 2, there is illustrated a display 10 according to the principles of the present invention. The display 10 would be installed in the selection room of a funeral home for facilitating the selection by a customer or a family member of a casket. As illustrated, the display 10 includes essentially three alcoves 12, 14 and 16, though it is to be understood that the present invention admits of many different possibilities and combinations and therefore is not to be limited to any specific number or arrangement of alcoves. Referring first to alcove 12, a vertical back wall 20 cooperates with a pair of vertical, spaced apart wing walls 22 and 24 to form the alcove 12. A soffit 26 spans the upper front edges of the wing walls 22 and 24 and may include recessed track lighting (not shown). A ceiling 28 is positioned near the upper edges of the back wall 20, wing walls 22 and 24 and soffit 26. The wing walls 22 and 24 are removably secured to the back wall 20 via fasteners as shown in the assignee's prior U.S. Pat. No. 5,405,017. Additionally, the soffit 26, recessed track lighting and ceiling 28 are also as shown in U.S. Pat. No. 5,405,017.

Figure 4:
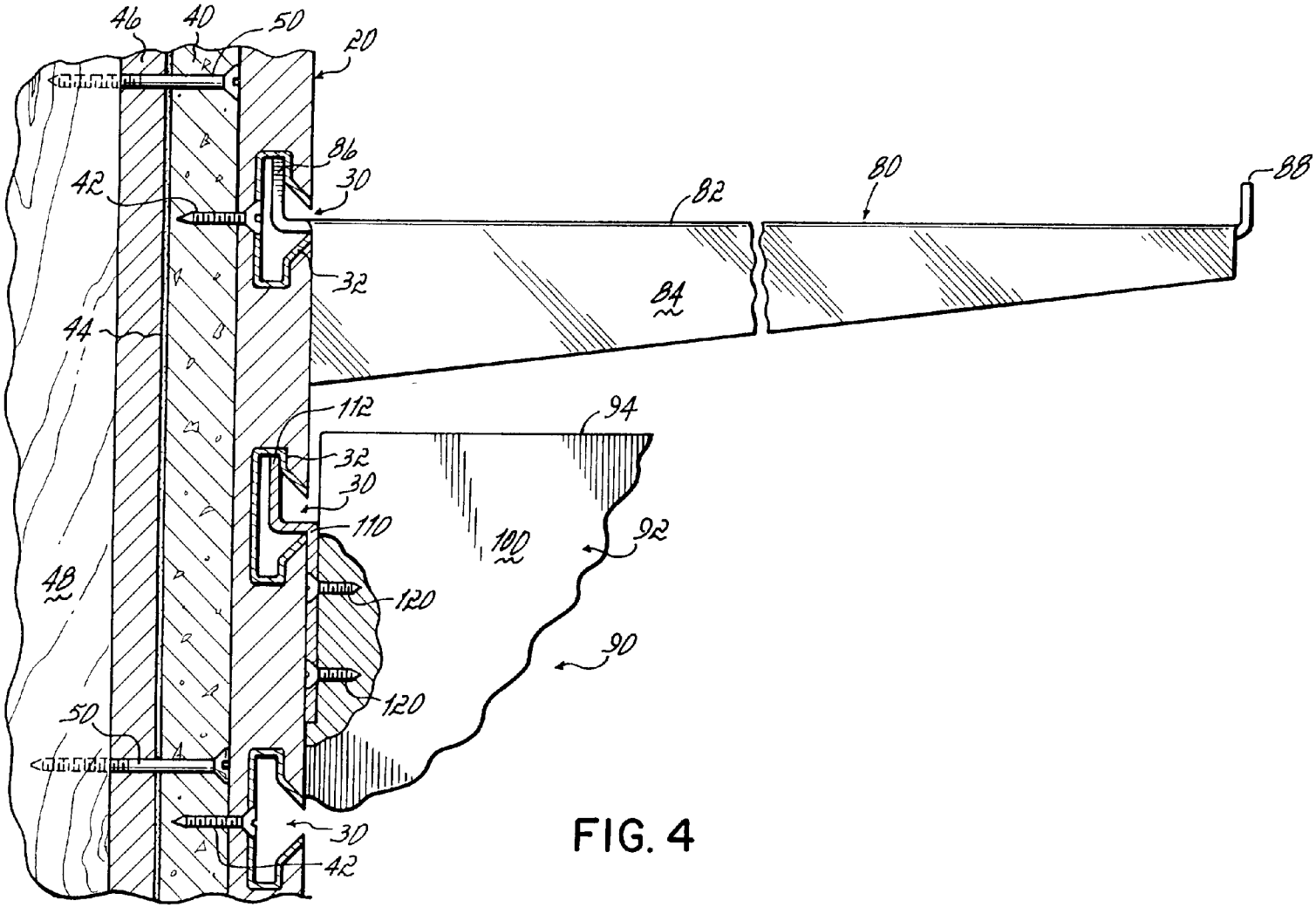
FIG. 4 is a partial vertical cross sectional view through the back wall of the display illustrating the back wall of the display attached to plywood which itself is attached to dry wall studs and illustrating the attachment of the shelves and information modules to the display back wall.

Referring now to FIGS. 1, 2 and 4, the construction of the back wall 20 is shown in more detail. Back wall 20 is a commercially available product known as "Slat Wall", available from Marlite of Dover, Ohio. The Slat Wall 20 includes a plurality of horizontal grooves 30 therein, each of which is lined with an aluminum extrusion 32 having generally a dovetailed cross-sectioned configuration. The Slat Wall 20 is mounted to a sheet of ¾" CDX plywood 40 with screws 42. Approximately 100 to 150 screws are required to secure a 4 ft.×8 ft. sheet of the Slat Wall 20 to the plywood 40. The plywood 40 is in turn glued with construction adhesive 44, for example "Liquid Nails", available from the Glidden Company of Cleveland, Ohio, to the dry wall 46 and additionally screwed to the wall studs 48 with 2½" No. 6 screws 50. Screws 50 are preferably spaced approximately 6" apart down each stud 48. (If the plywood 46 is to be mounted to masonry, then the plywood may be attached to the masonry with the appropriate masonry screws, for example a masonry fastener known as "Tapcon", available from Elco Industries, Inc. of Rockford, Ill.) The adhesive 44 is preferably placed as ⅜" wide beads, spaced four inches apart up and down the stud lines. In the event that signage, for example a category sign, is mounted to the Slat Wall 20, the Slat Wall 20 is similarly secured to the plywood 40 with construction adhesive.

Figure 3:
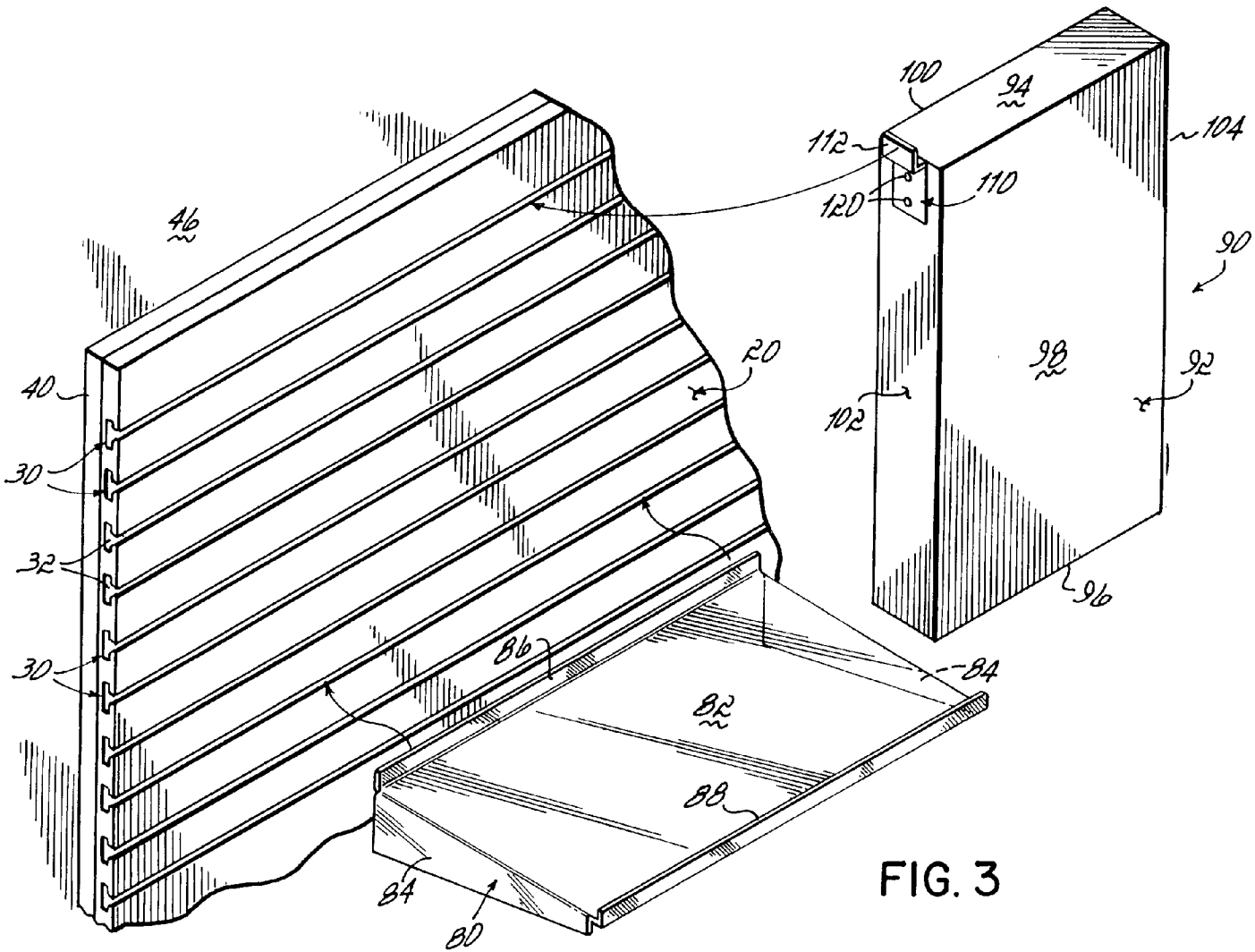
FIG. 3 is a perspective view illustrating the grooved rear wall of the display and the method of attaching the casket portion shelves and information modules to the grooved wall.

Referring now back to FIGS. 1 and 2, alcove 12 includes a plurality of casket portions 60, 62, 64, 66, 68 and 70 displayed therein. Each of the casket portions represents a different casket choice from which the customer or family member may select. In other words, each of the casket portions are of a different color, material, finish and/or include different hardware styles. The casket portions are each removably positioned atop a shelf 80. Referring to FIGS. 3 and 4, a typical shelf 80 used as a display 10 is illustrated. The shelf 80, fabricated of, for example, transparent acrylic, includes a casket portion supporting surface 82, a pair of lateral stiffening gussets 84, and upwardly projecting back and front lips 86 and 88 respectively. As is seen in FIG. 4, back lip 86 of shelf 80 may be inserted within the groove 30 to thereby cantilever the shelf 80 from the wall 22. Front lip 88 prevents the respective casket portion from being inadvertently dragged off the front edge of the shelf 80.

Referring still to FIGS. 1 and 2, it will be seen that the casket portions may take one of many forms. For example, portions 60 and 62 are short quarter sections of a casket showing half of an end wall and an end portion of a side wall of a casket. Portions 64 and 66 are portions which show a short length of the casket side wall. Portion 68 shows a short length of the entire end of a casket. It will thus be appreciated that many different configurations of casket portions may be displayed in the alcove 12 depending on the positioning of the shelves 80 and the selection of the portion of the casket to be displayed. As can be appreciated, in the alcove 12 of the display 10 as many as eight different caskets may be represented.

Figure 5:
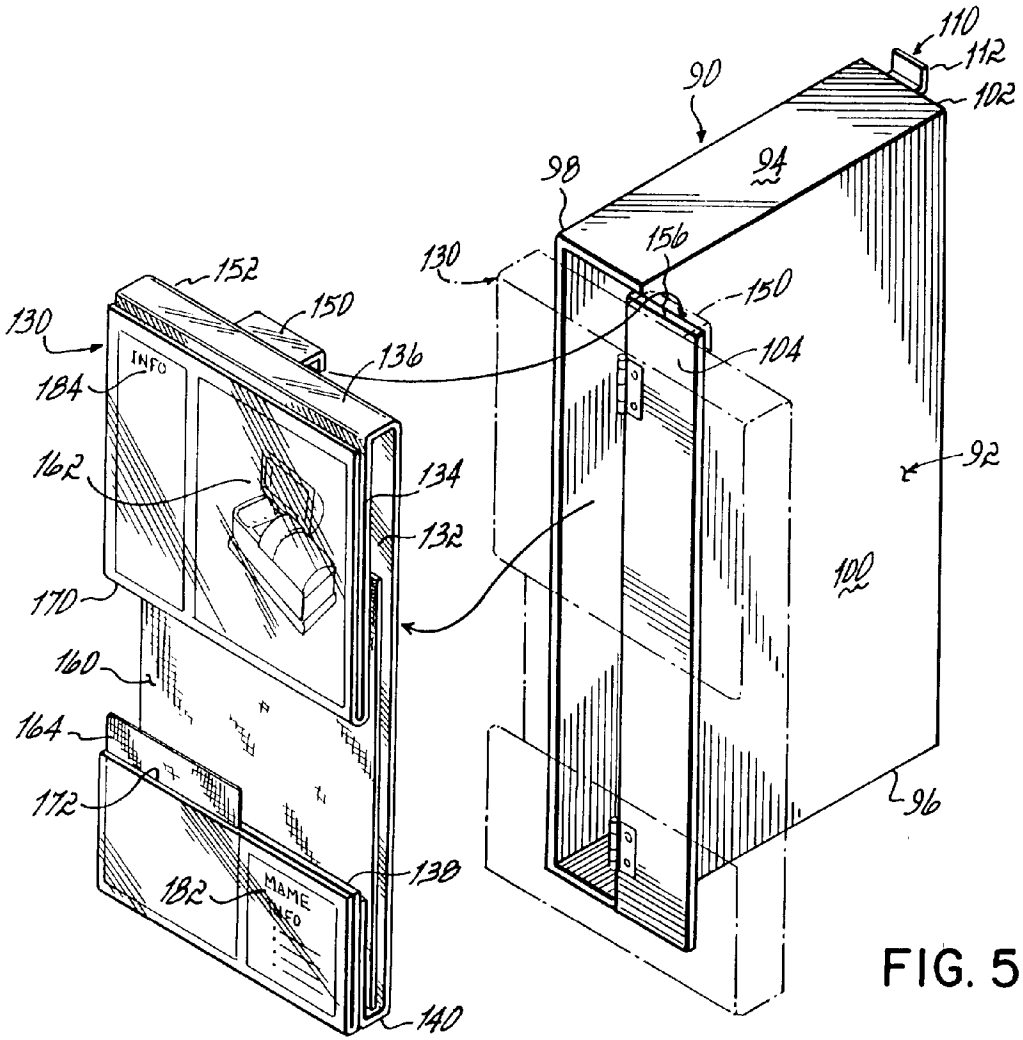
FIG. 5 is an exploded perspective view illustrating the information module comprising an enclosure with an openable and closable door and a removable information insert which is hangable on the door when the door is open and the insert is withdrawn from the enclosure.

A plurality of casket information modules 90 are displayed in the alcove 12. Like the shelves 80, each information module 90 is removably secured to the back wall 20, and corresponds to one of the casket portions 60, 62, 64, 66, 68 and 70 displayed in the alcove. Referring now to FIGS. 3–5, it will be seen that each information module 90 includes an enclosure 92 including top and bottom walls 94 and 96, side walls 98 and 100 and a rear wall 102. A door 104 is pivoted to one of the side walls 100 and is movable to and between a closed position and an open position. The enclosure 90 is preferably fabricated of pressed wood and is assembled with wood screws. A bracket 110 including an upwardly extending lip 112 is secured to the rear wall 102 in an upper location via screws 120. Lip 112 is receivable in one of the grooves 30 in the wall 20 in a manner similar to the manner that back lip 86 of shelf 80 may be inserted in groove 30. The information module 90 is thereby cantilevered from wall 20 in the same manner as the shelves 80. While it is preferable to orient the information modules 90 vertically, it is within the scope of the present invention to orient information modules 90 horizontally as illustrated.

Each information module 90 further includes an insert 130 fabricated of a transparent material such as acrylic. The information insert 130 includes a first pocket 132, a second pocket 134 attached to an upper edge 136 of first pocket 132 and a third pocket 138 attached to a lower edge 140 of first pocket 132. The first pocket 132 is generally C-shaped in cross section, whereas the second and third pockets 134 and 138, respectively, are generally U-shaped in cross section. Preferably the first, second and third pockets 132, 134 and 138 are integrally fabricated as by molding. Of course it will be appreciated that either or both of the small pockets 134 and/or 138 may be eliminated, depending on how much information is desired to be displayed in the information insert 130. The information insert 130 further includes a hook 150 attached to the back side 152 of the insert 130 in an upper location. Hook 150 is positionable over the top edge 156 of the door 104. In this way, a funeral director illustrating the features of the various caskets which are represented by the casket portions in the alcove may remove the insert 130 from the module 90 associated with one of the casket portions and hang the insert 130 on the edge 156 of the door 104 thereby permitting easy viewing of information in the insert 130.

In particular, it is contemplated that the insert 130 would include a portion of a cap panel 160 positioned in the first pocket 132. The second pocket 134 would include a photo 162 of the casket, and the third pocket 138 would include a fabric swatch 164 of the fabric of the casket. The lower edge 170 of the second pocket 134 is preferably spaced above the upper edge 172 of the third pocket 138. In this manner, the cap panel 160 is easily viewed between the lower and upper edges 170 and 172, respectively, of the upper and lower pockets 134 and 138, respectively. Furthermore, a customer may access the cap panel 160 to feel the fabric thereon. Similarly, it is contemplated that the fabric swatch 164, which might be mounted on a card (not shown) to provide rigidity, is of a height such that its upper edge 180 extends above the upper edge 172 of the third pocket 138, similarly allowing the customer to touch and feel the fabric 164. Additionally, information cards such as those shown at 182 and 184 may also be positioned in the second and third pockets 134 and 138, respectively. In the event that one or the other of the small pockets 134 and 138 are eliminated then of course less information would be displayable in the insert 130 as compared to that illustrated.

Referring now back to FIGS. 1 and 2, the alcoves may include a vertical signage column such as that shown at 200 in any or all of the alcoves 12, 14 and 16. The signage column 200 has a square cross section and extends from the floor to a lower edge 202 of the soffit 26 or substantially to an upper edge of the back wall. The column 200 is positioned in the alcove, for example alcove 12, such that one wall (not shown) abuts the back wall 20 and another adjacent wall 204 abuts one of the wing walls 22. Thus, two remaining walls 206 and 208, the front wall and the laterally inboard side wall, respectively, may be utilized to display information thereon. The signage columns or graphics towers 200 are intended to be utilized as "positioning devices" identifying a specific theme for the alcove, be it the physical material of the casket (wood, metal, etc.) or a lifestyle particularly identified with the deceased (male or female gender, personal lifestyles or orientations like religious, patriotic, outdoorsman, athletic, etc.). It is contemplated that the graphics towers/signage columns would provide informational text and imagery to describe particular product offerings, as well as more inspirational text/poetry and imagery to describe the person, the lifestyle, etc. in a way that will resonate with the consumer in this particular context. The latter may be referred to as "lifestyle orientation", i.e. providing a thematic lifestyle context for selection. The signage columns 200 are preferably fabricated of pressed wood and are assembled with wood screws. Graphics panels can be mounted in several ways on the column 200. First, transparent acrylic covers or the like (with or without frames) mounted on the columns 200 may be utilized to display signage, product information, photo imagery, text and the like thereunder. Second, graphic prints can be mounted to a foam or plastic substrate (including foam core, gator board, sintra or the like) and laminated with a UV protective laminating film. In this second case, no acrylic cover would be required. Third, the graphic print could be on a transparent film and then backlit with a light inside the column, making the column a "light box".

Referring still to FIGS. 1 and 2, it will be seen that the center alcove 14 includes an entire casket 220 displayed therein. Casket 220 is preferably supported atop a floor engaging support 222 such as a bier or the like. Alternatively, a two-tiered casket rack of the type disclosed in the assignee's U.S. Pat. No. 5,405,017 may be utilized to display two entire caskets stacked vertically in the alcove 14. With the center alcove 14 being utilized to display an entire casket 22 the left or right or both side alcoves 12 and/or 16 are utilized to display a plurality of casket portions in conjunction with corresponding information modules and vertical signage columns. In addition, the side alcoves 12 and 16 may include additional products either removably positioned on shelves removably secured to the back wall 20 or simply placed on the floor within the alcoves. These products may include, for example, cremation urns 230, vaults 232, head stones 234 and sympathy cards 236. Flower sprays may also be displayed in the alcoves. Additional signage may be mounted to the rear walls 20 as indicated at 240, 242, 244 and 246. Further, graphics 250 may be applied to the portion of the back wall 20 forming the back wall of the center alcove 14. The graphics 250 may be chosen to create a "theme" for the display 10, such as a patriotic theme for a deceased veteran, outdoor theme, sports theme or the like. Such graphics 250 in combination with the visual impact of the entire casket 220 in combination with the many casket portions and corresponding information displayed in the lateral side alcoves presents a dramatic presentation for a funeral customer which is tasteful and presents all of the information required to make selections from the display.

Figure 6:
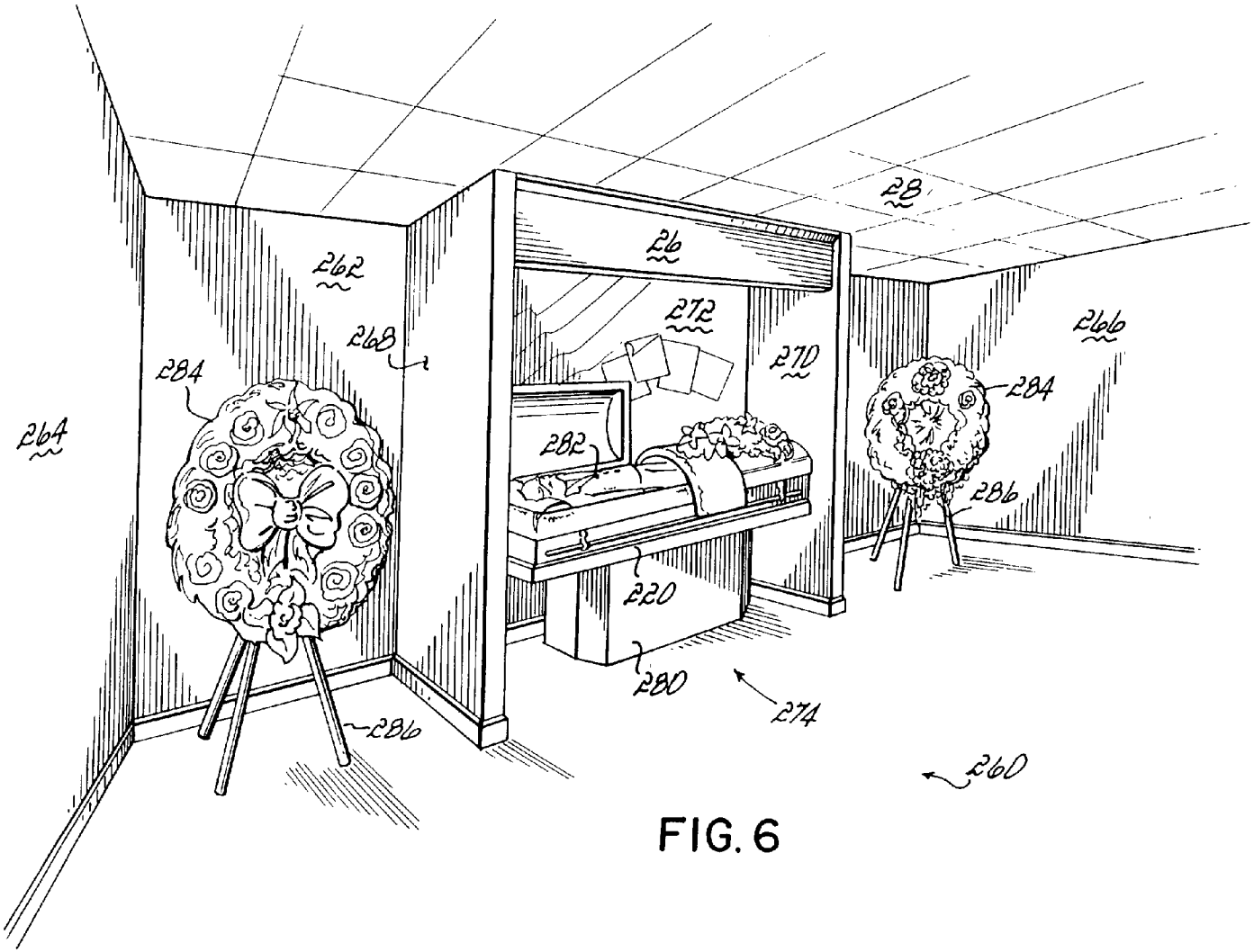
FIG. 6 illustrates the principles of the present invention adapted for use in the funeral home viewing room for display and viewing of a body of a deceased.

Referring now to FIG. 6, the principles of the present invention are illustrated adapted for use in a viewing room 260 of a funeral home. The funeral home viewing room 260 includes a back room wall 262 and a pair of side room walls 264 and 266. The walls 262, 264 and 266 form one end of the viewing room 260. A pair of wing wall panels 268 and 270 are positioned along the back wall 262. A casket 220 is displayed atop a pedestal or bier 280 with a body 282 of a deceased being displayed in the casket 220. Signage 272 of the type described above forms a background for the casket 220 and creates a theme for the alcove 274. Sprays of flowers 284 may be supported on easels 286 and positioned between each room wall 264 or 266 and its corresponding adjacent wing wall 268 or 270, respectively. Thus, the prior described room environment may be carried over from the casket selection room of a funeral home directly into the body viewing room of a funeral home with similar effects and advantages as described above. Further, the portions of the back wall 262 between the side walls 264 and 266 and their adjacent, respective wing walls 268 and 270 may include additional signage, text, graphics or memorabilia mounted thereto, by way of for example the use of the above-described Slatwall to build upon the theme chosen.

Those skilled in the art will readily recognize numerous adaptations and modifications which can be made to the present invention which will result in an improved selection room display, yet all of which will fall within the spirit and scope of the present invention as defined in the following claims. Accordingly, the invention is to be limited only by the scope of the following claims and their equivalents.

What is claimed is:

1. A selection room display for facilitating the selection by a customer of a casket, said display comprising:

a vertical back wall and a pair of vertical, spaced apart wing walls cooperating with said back wall to form an alcove;

a plurality of casket portions displayed in said alcove, said plurality of casket portions representing a plurality of casket choices from which the customer may select;

a vertical signage column positioned in said alcove displaying information;

wherein said alcove includes a plurality of casket information modules displayed therein, each of said information modules corresponding to one of said plurality of casket portions;

wherein said information modules are removably secured to said back wall;

wherein each said information module includes an enclosure and an information insert movable into and out of said enclosure;

wherein said enclosure includes a door pivotable to and between a closed position and an open position.

2. The display of claim 1 wherein said signage column has a square cross-section, extends from the floor substantially to an upper edge of said back wall and is positioned in said alcove such that one wall of said column abuts said back wall and another adjacent wall of said column abuts one of said wing walls.

3. The display of claim 1 wherein each of said plurality of casket portions is removably positioned atop a shelf removably secured to said back wall.

4. The display of claim 1 wherein said information insert is fabricated of a transparent material and comprises:

a first pocket having upper and lower edges;

a second pocket attached to said upper edge of said first pocket; and a third pocket attached to said lower edge of said first pocket;

said second pocket having a lower edge, said third pocket having an upper edge, said lower edge of said second pocket spaced above said upper edge of said third pocket.

5. The display of claim 4 wherein said first pocket is generally C-shaped in cross-section and said second and third pockets are generally U-shaped in cross-section.

6. The display of claim 4 wherein said first pocket includes therein a portion of a cap panel of the casket, said second pocket includes therein a photo of the casket and said third pocket includes therein a fabric swatch of the casket.

7. The display of claim 4 wherein said information insert further includes a hook on an upper back side thereof, said hook being positionable over an upper edge of said door when said door is in the open position to display said information insert.

8. The selection room display of claim 1, said column displaying text and graphics thereby creating a theme for said alcove, wherein said theme is the material from which the casket is fabricated.

9. The selection room display of claim 1, said column displaying text and graphics thereby creating a theme for said alcove, wherein said theme is the lifestyle of the deceased.

10. The selection room display of claim 9 wherein the lifestyle is one from the group consisting of gender, religion, patriotism, outdoors and athletics.

11. The selection room display of claim 1, said column displaying text and graphics thereby creating a theme for said alcove, wherein said back wall includes signage thereon, said signage corresponding to said text and graphics on said column.

12. A funeral home including a selection room display as claimed in claim 1.

13. A selection room display for facilitating the selection by a customer of a casket, said display comprising:

a vertical back wall and a pair of vertical, spaced apart wing walls cooperating with said back wall to form an alcove;

a plurality of casket portions displayed in said alcove, said plurality of casket portions representing a plurality of casket choices from which the customer may select, each of said plurality of casket portions being removably positioned atop a shelf which is removably secured to said back wall; and plurality of casket information modules displayed in said alcove, each of said information modules being removably secured to said back wall and corresponding to one of said plurality of casket portions;

wherein each said information module includes an enclosure and an information insert movable into and out of said enclosure;

wherein said enclosure includes a door pivotable to and between a closed position and an open position.

14. The display of claim 13 wherein said information insert is fabricated of a transparent material and comprises:

a first pocket having upper and lower edges;

a second pocket attached to said upper edge of said first pocket; and a third pocket attached to said lower edge of said first pocket;

said second pocket having a lower edge, said third pocket having an upper edge, said lower edge of said second pocket spaced above said upper edge of said third pocket.

15. The display of claim 14 wherein said first pocket is generally C-shaped in cross-section and said second and third pockets are generally U-shaped in cross-section.

16. The display of claim 14 wherein said first pocket includes therein a portion of a cap panel of the casket, said second pocket includes therein a photo of the casket and said third pocket includes therein a fabric swatch of the casket.

17. The display of claim 14 wherein said information insert further includes a hook on an upper back side thereof, said hook being positionable over an upper edge of said door when said door is in the open position to display said information insert.

18. A selection room display for facilitating the selection by a customer of a casket, said display comprising:

a vertical back wail including at least one horizontal groove therein;

a plurality of shelves removably secured to said back wall, each shelf of said plurality including an upstanding lip on a back edge thereof, said lip being received in said at least one horizontal groove thereby cantilevering said shelf from said back wall;

a plurality of casket portions each of which is displayed on one of said shelves; said plurality of casket portions representing a plurality of casket choices from which the customer may select; and a plurality of casket information modules displayed on said back wall, each of said information modules corresponding to one of said plurality of casket portions and including an upstanding lip on a back edge thereof, said lip being received in said at least one horizontal groove thereby cantilevering said information module from said back wall.

19. The display of claim 18 further including a pair of vertical, spaced apart wing walls cooperating with said back wall to form an alcove.

20. The display of claim 18 wherein each said information module includes an enclosure and an information insert movable into and out of said enclosure.

21. The display of claim 20 wherein said enclosure includes a door pivotable to and between a dosed position and an open position.

22. The display of claim 21 wherein said information insert is fabricated of a transparent material and comprises:

a first pocket having upper and lower edges;

a second pocket attached to said upper edge of said first pocket; and a third pocket attached to said lower edge of said first pocket;

said second pocket having a lower edge, said third pocket having an upper edge, said lower edge of said second pocket spaced above said upper edge of said third pocket.

23. The display of claim 22 wherein said information insert further includes a hook on an upper back side thereof, said hook being positionable over an upper edge of said door when said door is in the open position to display said information insert.

24. A selection room display for facilitating the selection by a customer of a casket, said display comprising:

a vertical back wall and two pairs of vertical, spaced apart wing walls cooperating with said back wall to form centrally positioned center alcove and two laterally positioned side alcoves, one of said two side alcoves being positioned on each side of said center alcove;

an entire casket displayed in said center alcove; and a plurality of casket portions displayed in each said side alcove;

further including a plurality of casket information modules displayed in said side alcoves, each of said information modules corresponding to one of said plurality, of casket portions;

wherein said information modules are removably secured to said back wall;

wherein each said information module includes an enclosure and an information insert movable into and out of said enclosure, wherein said enclosure includes a door pivotable to and between a closed position and an open position.

25. The display of claim 24 wherein said entire casket is supported atop a floor-engaging support, and wherein each of said plurality of casket portions is removably positioned atop a shelf which is removably secured to said back wall.

26. The display of claim 24 further including a vertical signage column positioned in at least one of said side alcoves displaying information.

27. The display of claim 24 wherein said information insert is fabricated of a transparent material and comprises:

a first pocket having upper and lower edges;

a second pocket attached to said upper edge of said first pocket; and a third pocket attached to said lower edge of said first pocket;

said second pocket having a lower edge, said third pocket having an upper edge, said lower edge of said second pocket spaced above said upper edge of said third pocket.

28. The display of claim 27 wherein said first pocket is generally C-shaped in cross-section and said second and third pockets are generally U-shaped in cross-section.

29. The display of claim 28 wherein said first pocket includes therein a portion of a cap panel of the casket, said second pocket includes therein a photo of the casket and said third pocket includes therein a fabric swatch of the casket.

30. The display of claim 27 wherein said information insert further includes a hook on an upper back side thereof, said hook being positionable over an upper edge of said door when said door is in the open position to display said information insert.

31. The display of claim 24 further including cremation urns, vaults, headstones and sympathy cards displayed in said side alcoves.

32. The display of claim 24 further including graphics displayed on a central portion of said back wall forming said center alcove.

33. The display of claim 24 further including a vertical signage column positioned in each said side alcove.

34. A selection room display for facilitating the selection by a customer of a casket, said display comprising:

a vertical back wall and two pairs of vertical, spaced apart wing walls cooperating with said back wall to form centrally positioned center alcove and two laterally positioned side alcoves, one of said two side alcoves being positioned on each side of said center alcove;

an entire casket displayed in said center alcove; and a plurality of casket portions displayed in each said side alcove;

wherein:

lateral side portions of said back wall forming said side alcoves each include a plurality of horizontal grooves therein;

a plurality of shelves are removably secured to said lateral side portions of said back wall, each shelf of said plurality including an upstanding lip on a back edge thereof, said lip being received in one of said horizontal grooves thereby cantilevering said shelf from said back wall;

a plurality of casket portions representing a plurality of casket choices from which the customer may select are displayed on said shelves; and a plurality of casket information modules are displayed on said lateral side portions of said back wall, each of said information modules corresponding to one of said plurality of casket portions and including an upstanding lip on a back edge thereof, said lip being received in one of said horizontal grooves thereby cantilevering said information module from said back wall.

35. The display of claim 34 wherein each said information module includes an enclosure and an information insert movable into and out of said enclosure.

36. The display of claim 35 wherein said enclosure includes a door pivotable to and between a closed position and an open position.

37. The display of claim 36 wherein said information insert is fabricated of a transparent material and comprises:

a first pocket having upper and lower edges;

a second pocket attached to said upper edge of said first pocket; and a third pocket attached to said lower edge of said first pocket;

said second pocket having a lower edge, said third pocket having an upper edge, said lower edge of said second pocket spaced above said upper edge of said third pocket.

38. The display of claim 37 wherein said first pocket is generally C-shaped in cross-section and said second and third pockets are generally U-shaped in cross-section.

39. The display of claim 38 wherein said first pocket includes therein a portion of a cap panel of the casket, said second packet includes, therein a photo of the casket and said third pocket includes therein a fabric swatch of the casket.

40. The display of claim 39 wherein said information insert further includes a hook on an upper back side thereof, said hook being positionable over an upper edge of said door when said door is in the open position to display said information insert.

* * * * *